US011487234B2

(12) United States Patent
Taoka et al.

(10) Patent No.: US 11,487,234 B2
(45) Date of Patent: Nov. 1, 2022

(54) SHEET ACCOMMODATING APPARATUS AND IMAGE FORMING APPARATUS

(71) Applicant: CANON KABUSHIKI KAISHA, Tokyo (JP)

(72) Inventors: Keitaro Taoka, Chiba (JP); Misaki Shiozawa, Chiba (JP); Hajime Sekiguchi, Chiba (JP); Isao Kannari, Saitama (JP); Hiroyuki Nakagawa, Chiba (JP); Kouyou Tamura, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/320,273

(22) Filed: May 14, 2021

(65) Prior Publication Data

US 2021/0382429 A1 Dec. 9, 2021

(30) Foreign Application Priority Data

Jun. 4, 2020 (JP) ..... JP2020-097608

(51) Int. Cl.
*G03G 15/00* (2006.01)
*B65H 43/02* (2006.01)

(52) U.S. Cl.
CPC ..... *G03G 15/70* (2013.01); *B65H 43/02* (2013.01); *G03G 15/6502* (2013.01); *B65H 2515/60* (2013.01)

(58) Field of Classification Search
CPC ..... B65H 43/02; B65H 2515/60; G03G 15/6502; G03G 15/70
See application file for complete search history.

(56) References Cited

U.S. PATENT DOCUMENTS 9,678,465 B2 6/2017 Katsuyama
10,836,594 B2 11/2020 Shiozawa
2002/0061197 A1* 5/2002 Matsuura ..... G03G 15/6591 399/45
2004/0213590 A1* 10/2004 Schroath ..... G03G 15/70 399/21
2013/0336667 A1* 12/2013 Watanabe ..... G03G 15/6555 399/23

(Continued)

FOREIGN PATENT DOCUMENTS

JP 2014-238566 A 12/2014

*Primary Examiner* — David H Banh
(74) *Attorney, Agent, or Firm* — Venable LLP

(57) ABSTRACT

A sheet accommodating apparatus includes an apparatus body, a first cassette to be drawn out in a draw-out direction with respect to the apparatus body, a second cassette disposed adjacent to the first cassette in a vertical direction, a holder member attached to the apparatus body, and a first light emitting member and a second light emitting member that are supported by the holder member. The first cassette includes a first accommodating container and a first cover. The second cassette includes a second accommodating container and a second cover. The first cover has a first hole in a position opposing the first light emitting member such that the light emitted from the first light emitting member passes therethrough. The second cover has a second hole provided in a position opposing the second light emitting member such that the light emitted from the second light emitting member passes therethrough.

11 Claims, 7 Drawing Sheets

(56) References Cited

U.S. PATENT DOCUMENTS

| | | | | |
|---|---|---|---|---|
| 2014/0334834 | A1* | 11/2014 | Katsuyama | G03G 15/70 399/21 |
| 2015/0197402 | A1* | 7/2015 | Yamaoka | B65H 1/14 271/153 |
| 2016/0209774 | A1* | 7/2016 | Abe | G03G 15/065 |
| 2017/0269527 | A1* | 9/2017 | Kaneko | G03G 15/5025 |
| 2020/0354177 | A1 | 11/2020 | Nakagawa | |

* cited by examiner

SHEET ACCOMMODATING APPARATUS AND IMAGE FORMING APPARATUS

BACKGROUND OF THE INVENTION

Field of the Invention

The present invention relates to a sheet accommodating apparatus that accommodates a sheet, and to an image forming apparatus including the sheet accommodating apparatus.

Description of the Related Art

Conventionally, an image forming apparatus that includes a plurality of sheet feed trays that each accommodate a sheet and forms an image on a fed sheet is proposed in, for example, Japanese Patent Laid-Open No. 2014-238566. Light emitting members are respectively provided in correspondence with the plurality of sheet feed trays. A light emitting member corresponding to a sheet feed tray feeding a sheet emits light, and thus a user can recognize that the corresponding sheet feed tray cannot be replenished with sheets.

A light emitting member described in Japanese Patent Laid-Open No. 2014-238566 includes a light emitting diode element: an LED element disposed in an apparatus body of the image forming apparatus, and a light guiding member disposed in a sheet feed tray. In addition, a shutter member that operates in accordance with the movement of the sheet feed tray is provided in the apparatus body, and adjusts the amount of light that is emitted from the LED element and reaches the user.

These members are provided in correspondence with the number of sheet feed trays. However, this increases the number of parts, and since it is not easy to mount these members on the sheet feed trays, this can cause deterioration of the efficiency of assembly and maintenance.

SUMMARY OF THE INVENTION

According to one aspect of the present invention, a sheet accommodating apparatus includes a first cassette configured to accommodate a sheet and provided so as to be drawn out in a draw-out direction, a second cassette configured to accommodate a sheet and provided so as to be drawn out in the draw-out direction, the second cassette being disposed adjacent to the first cassette in a vertical direction, one holder member, and a first light emitting member and a second light emitting member that are supported by the holder member and configured to emit light. The first cassette includes a first accommodating container configured to accommodate a sheet, and a first cover provided downstream of the first accommodating container in the draw-out direction and constituting part of an exterior of the sheet accommodating apparatus. The second cassette includes a second accommodating container configured to accommodate a sheet, and a second cover provided downstream of the second accommodating container in the draw-out direction and constituting part of the exterior of the sheet accommodating apparatus. The first cover has a first hole provided in a position opposing the first light emitting member in the draw-out direction such that the light emitted from the first light emitting member passes therethrough. The second cover has a second hole provided in a position opposing the second light emitting member in the draw-out direction such that the light emitted from the second light emitting member passes therethrough.

Further features of the present invention will become apparent from the following description of exemplary embodiments with reference to the attached drawings.

DESCRIPTION OF THE EMBODIMENTS

First Embodiment

Overall Configuration

First, a first embodiment of the present invention will be described. A printer 100 serving as an image forming apparatus according to the first embodiment is a full-color laser beam printer of an electrophotographic system that forms an image on a sheet S serving as a recording material on the basis of image information read from a document or image information received from an external device. Examples of sheets used as recording materials or documents include paper sheets such as regular paper sheets and cardboards, plastic films such as sheets for overhead projectors, cloths, surface-treated sheet materials such as coated paper sheets, and sheet materials of irregular shapes such as envelops and index sheets.

Figure 1:
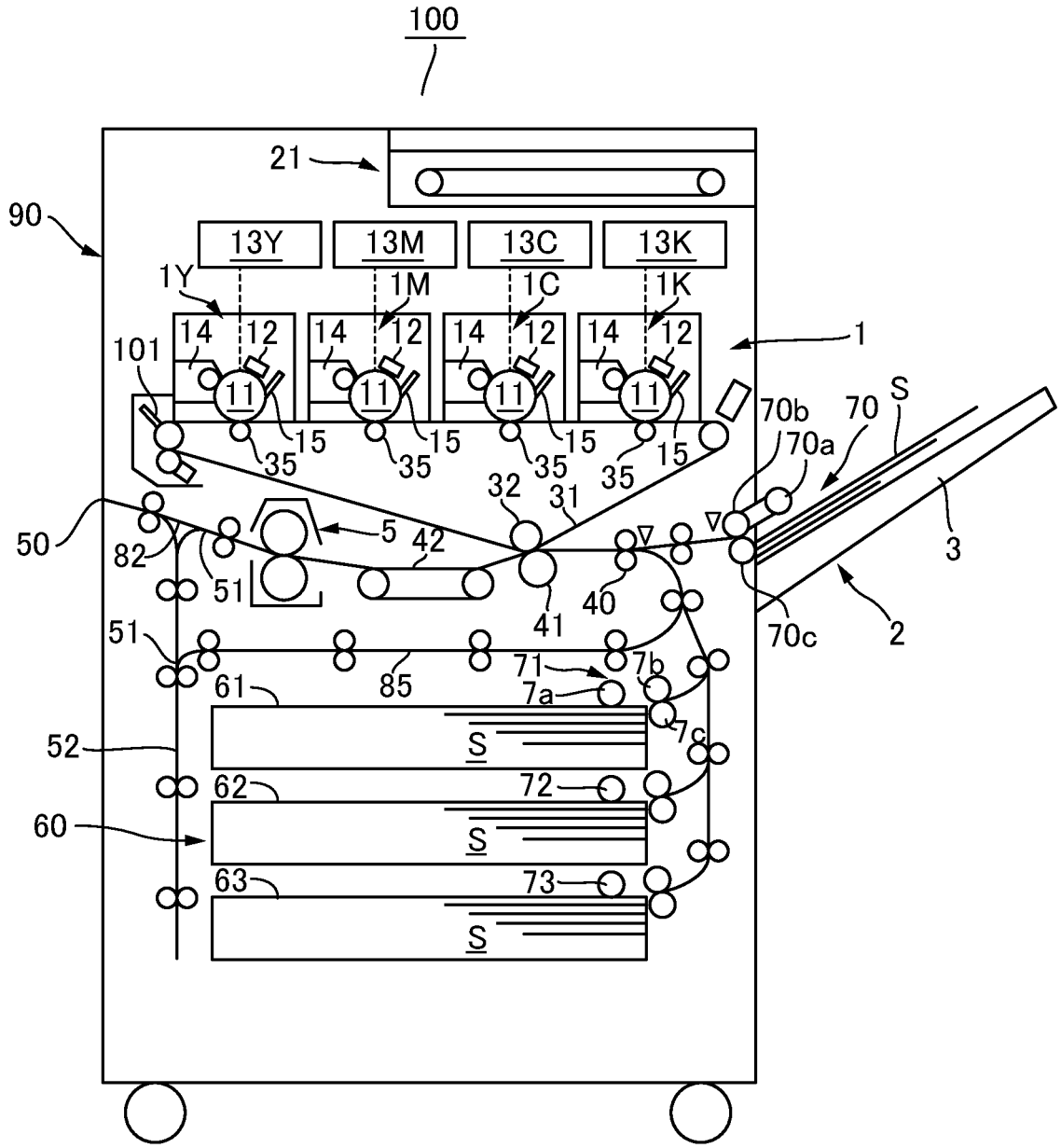
FIG. 1 is an overall schematic view of a printer according to a first embodiment.

As illustrated in FIG. 1, the printer 100 includes a reader portion 21 that reads an image of a document, and an apparatus body 90 provided below the reader portion 21. The apparatus body 90 includes a cassette feeding portion 60, an image forming portion 1, a fixing unit 5, and a manual feed portion 2.

The image forming portion 1 includes scanner portions 13Y, 13M, 13C, and 13K, and four process cartridges 1Y, 1M, 1C, and 1K that respectively form images of four colors of yellow, magenta, cyan, and black. The four process cartridges 1Y to 1K have the same configuration except that the colors of images formed thereby are different. Only an image forming process of the process cartridge 1Y will be described below, and description of the process cartridges 1M, 1C, and 1K will be omitted.

The scanner portion 13Y radiates laser light toward a photosensitive drum 11 of the process cartridge 1Y on the basis of image information that has been input. At this time, the photosensitive drum 11 is charged by a charging unit 12 in advance, and as a result of being irradiated with the laser light, an electrostatic latent image is formed on the photosensitive drum 11. Then, the electrostatic latent image is developed by a developing unit 14, and a yellow toner image is formed on the photosensitive drum 11.

Similarly, magenta, cyan, and black toner images are respectively formed on photosensitive drums of the process cartridges 1M, 1C, and 1K. The toner images of respective colors formed on the photosensitive drums are transferred onto an intermediate transfer belt 31 by primary transfer rollers 35, and are conveyed to a secondary transfer inner roller 32 by rotation of the intermediate transfer belt 31. Attached matter such as transfer residual toner remaining on the photosensitive drums without being transferred onto the intermediate transfer belt 31 is removed by cleaning blades 15. To be noted, the image forming process of each color is performed at such a timing that a toner image formed thereby is superimposed on a toner image transferred onto the intermediate transfer belt 31 through primary transfer and conveyed from the upstream side.

In parallel with the image forming process described above, a sheet S is fed from the cassette feeding portion 60 or the manual feed portion 2. The cassette feeding portion 60 includes 3-tier feeding cassettes 61, 62, and 63 and feeding units 71, 72, and 73 respectively corresponding to the feeding cassettes 61, 62, and 63, and feeds the sheet S from, for example, a feeding cassette appropriately selected in accordance with the sheet size.

The feeding units 71 to 73 each include a pickup roller 7*a* that delivers out the uppermost sheet S from the feeding cassette, a feed roller 7*b* that receives the sheet S from the pickup roller 7*a* and conveys the sheet S, and a retard roller 7*c* that abuts the feed roller 7*b*. The retard roller 7*c* receives a driving force in a direction opposite to the rotation of the feed roller 7*b* through a torque limiter. The retard roller 7*c* applies a frictional force in a direction opposite to the feeding direction to a sheet entering a separation nip between the feed roller 7*b* and the retard roller 7*c*, and thus pushes back sheets other than the uppermost sheet S. The feeding units 71 to 73 thus configured are examples of a feeding apparatus that feeds a sheet, and for example, an air feeding system that sucks air to attract the uppermost sheet to a belt and feeds the uppermost sheet may be used. In addition, as a separation member that separates one sheet from other sheets when a plurality of sheets are fed, a friction member of a pad shape may be used instead of the retard roller 7*c*.

The manual feed portion 2 includes a manual feed tray 3 projecting to the side from an apparatus body 90, and a feeding unit 70 that feeds a sheet S set on the manual feed tray 3. The basic configuration of the feeding unit 70 is the same as those of the feeding units 71 to 73 of the cassette feeding portion 60. That is, the feeding unit 70 includes a pickup roller 70*a* that delivers out the uppermost sheet S from the manual feed tray 3, a feed roller 70*b* that receives the sheet S from the pickup roller 70*a* and conveys the sheet S, and a retard roller 70*c* that abuts the feed roller 70*b*.

The skew of the sheet S fed from the cassette feeding portion 60 or the manual feed portion 2 is corrected by a registration roller pair 40, and the sheet S whose skew has been corrected is conveyed at a predetermined conveyance timing. Then, a full-color toner image on the intermediate transfer belt 31 is transferred onto the sheet S by the secondary transfer inner roller 32 and a secondary transfer outer roller 41. Attached matter such as transfer residual toner remaining on the intermediate transfer belt 31 without being transferred onto the sheet S is removed by a cleaning blade 101. The sheet S onto which the toner image has been transferred is conveyed by a belt conveyance member 42 and subjected to predetermined heat and pressure in the fixing unit 5, and thus the toner thereon is melted and fixed. The sheet S having passed through the fixing unit 5 is discharged to the outside of the apparatus through a discharge port 50.

In the case of forming images on both surfaces of a sheet, the sheet S on a first surface of which an image has been formed and which has passed through the fixing unit 5 is conveyed to a reverse conveyance path 52 and switched back. Thus, the front side and back side of the sheet S is reversed. Then, the sheet S is conveyed to the registration roller pair 40 again through a duplex conveyance path 85, and a toner image is transferred onto a second surface of the sheet S by the secondary transfer inner roller 32 and the secondary transfer outer roller 41.

The image forming portion 1 provided in the printer 100 of the present embodiment is an example of an image forming portion that forms an image on a sheet, and an electrophotographic unit of a direct transfer system that transfers a toner image onto the sheet from a photosensitive member without using an intermediate transfer member may be used. In addition, an image forming portion of a system other than the electrophotographic system such as an image forming unit of an inkjet system or a printing mechanism of an offset printing system may be used.

Cassette Feeding Portion

Figure 2A:
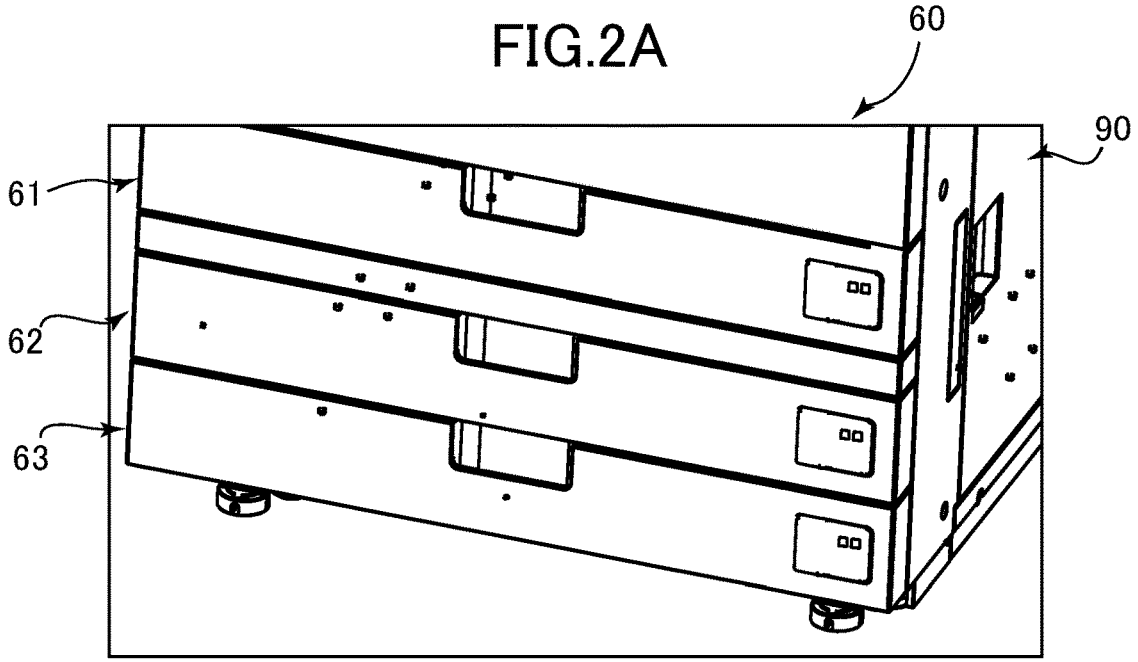
FIG. 2A is a perspective view of feeding cassettes attached to an apparatus body.
Figure 2B:
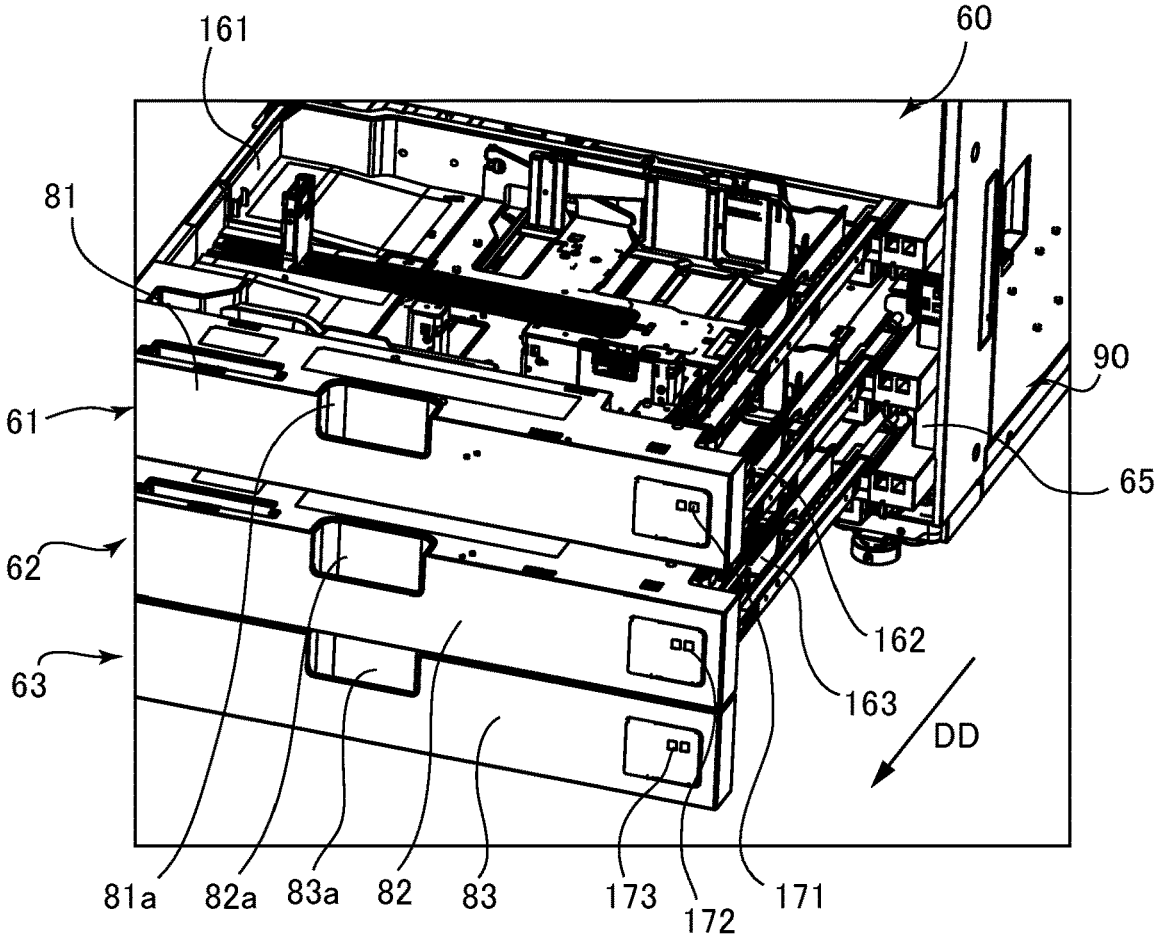
FIG. 2B is a perspective view of the feeding cassettes drawn out from the apparatus body.

Next, the cassette feeding portion 60 serving as a sheet accommodating apparatus will be described in detail with reference to FIGS. 2A to 3. As illustrated in FIGS. 2A and 2B, the cassette feeding portion 60 includes the 3-tier feeding cassettes 61, 62, and 63 arranged adjacent to each other in the vertical direction, and the feeding cassettes 61, 62, and 63 are provided so as to be drawn out in a draw-out direction DD from the apparatus body 90.

The feeding cassette 61 serving as a first cassette includes an accommodating portion 161 serving as a first accommodating container that accommodates sheets, and a cassette front cover 81 serving as a first cover provided downstream of the accommodating portion 161 in the draw-out direction DD. The cassette front cover 81 includes a grip portion 81*a* that is fixed to the accommodating portion 161 and is gripped by a user to facilitate drawing out the feeding cassette 61.

Similarly, the feeding cassette 62 serving as a second cassette includes an accommodating portion 162 serving as a second accommodating container that accommodates sheets, and a cassette front cover 82 serving as a second cover provided downstream of the accommodating portion 162 in the draw-out direction DD. The cassette front cover 82 includes a grip portion 82*a* that is fixed to the accommodating portion 162 and is gripped by a user to facilitate drawing out the feeding cassette 62.

Further, the feeding cassette 63 includes an accommodating portion 163 that accommodates sheets, and a cassette front cover 83 provided downstream of the accommodating portion 163 in the draw-out direction DD. The cassette front cover 83 includes a grip portion 83*a* that is fixed to the accommodating portion 163 and is gripped by a user to facilitate drawing out the feeding cassette 63.

The cassette front covers 81, 82, and 83 constitute part of the exterior of the cassette feeding portion 60 or the printer 100. The cassette front covers 81, 82, and 83 respectively have holes 171, 172, and 173 defined therein penetrating through the cassette front covers 81, 82, and 83 in the draw-out direction DD. The holes 171, 172, and 173 are respectively provided in right end portions of the cassette front covers 81, 82, and 83.

Figure 3:
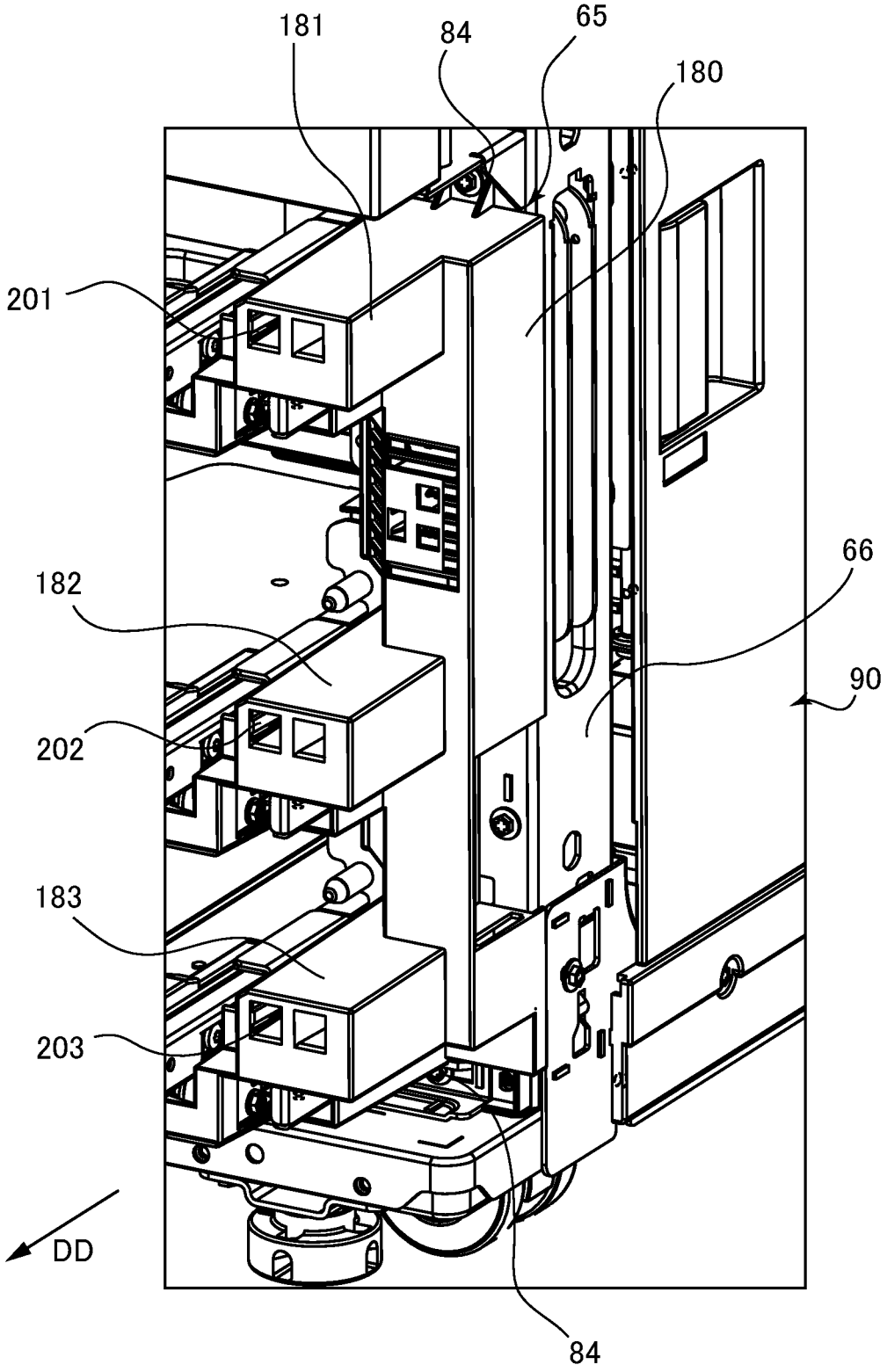
FIG. 3 is a perspective view of a holder member.

As illustrated in FIG. 3, a prop 66 provided on the front right side of the apparatus body 90 supports a holder member 65. The holder member 65 includes a base portion 180 attached to the prop 66, and holding portions 181, 182, and 183 extending in the draw-out direction from the base portion 180. The base portion 180 is fixed to the prop 66 by screwing upper and lower installation surfaces 84 thereof to the prop 66. The holding portions 181, 182, and 183 are arranged separately in the vertical direction.

Figure 4C:
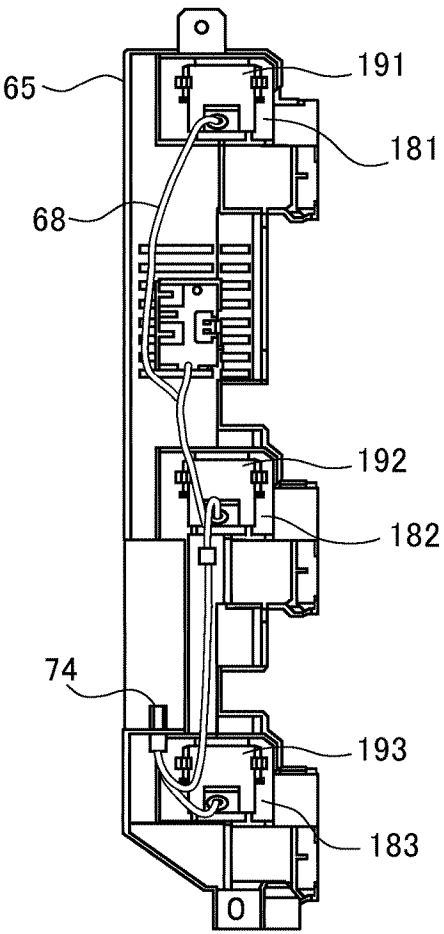
FIG. 4C is a section view of the holder member illustrating an inner configuration thereof.

As illustrated in FIGS. 3 to 4C, the holding portion 181 serving as a first holding portion holds a light emitting member 191 serving as a first light emitting member, and has a hole 201 through which light radiated from the light emitting member 191 passes. The holding portion 182 serving as a second holding portion holds a light emitting member 192 serving as a second light emitting member, and has a hole 202 through which light radiated from the light emitting member 192 passes. The holding portion 183 holds a light emitting member 193, and has a hole 203 through which light radiated from the light emitting member 193 passes. The light emitting members 191, 192, and 193 each include an LED.

Figure 4B:
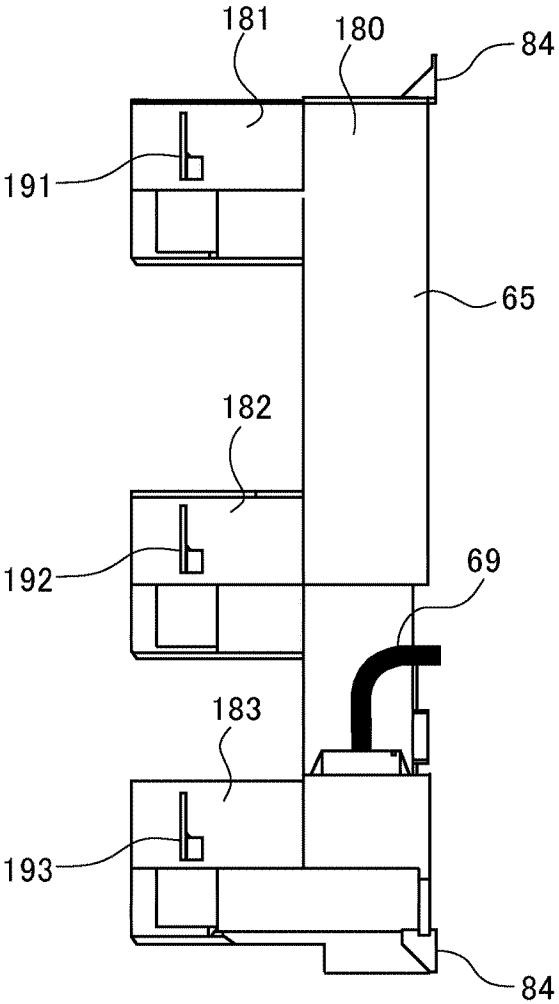
FIG. 4B is a side view of the holder member.
Figure 4A:
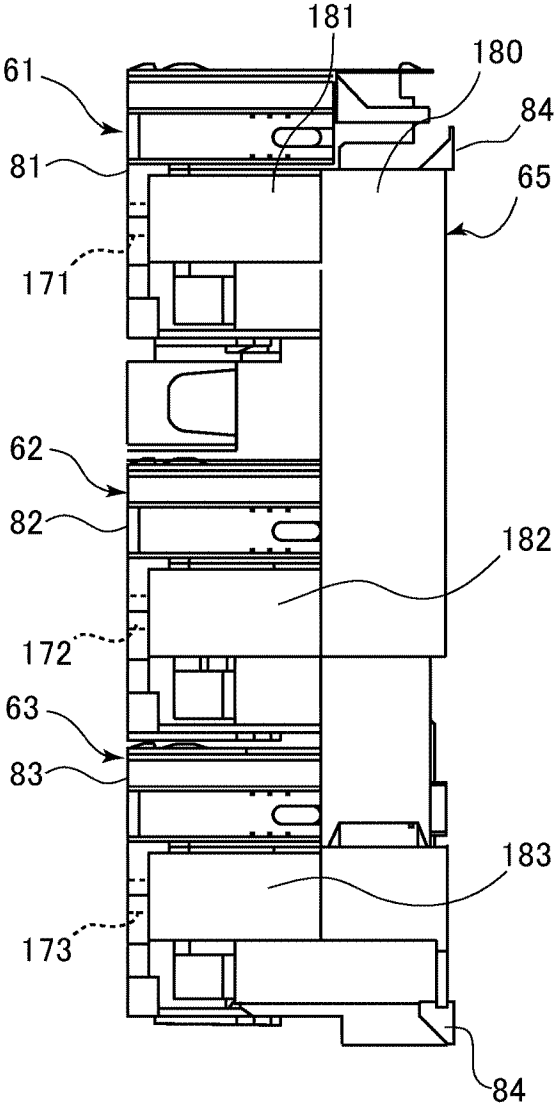
FIG. 4A is a side view of a feeding cassette illustrating a positional relationship between a cassette front cover and the holder member.

The holding portion 181 is adjacent to the hole 171 of the cassette front cover 81 serving as a first hole when the feeding cassette 61 is attached to the apparatus body 90. At this time, as illustrated in FIGS. 4A and 4B, the light emitting member 191 is opposed to and adjacent to the hole 171 in the draw-out direction DD. Therefore, light emitted from the light emitting member 191 passes through the hole 201 of the holding portion 181 and the hole 171 of the feeding cassette 61, and illuminates the outside of the apparatus.

The holding portion 182 is adjacent to the hole 172 of the cassette front cover 82 serving as a second hole when the feeding cassette 62 is attached to the apparatus body 90. At this time, as illustrated in FIGS. 4A and 4B, the light emitting member 192 is opposed to and adjacent to the hole 172 in the draw-out direction DD. Therefore, light emitted from the light emitting member 192 passes through the hole 202 of the holding portion 182 and the hole 172 of the feeding cassette 62, and illuminates the outside of the apparatus.

In addition, the holding portion 183 is adjacent to the hole 173 of the cassette front cover 83 when the feeding cassette 63 is attached to the apparatus body 90. At this time, as illustrated in FIGS. 4A and 4B, the light emitting member 193 is opposed to and adjacent to the hole 173 in the draw-out direction DD. Therefore, light emitted from the light emitting member 193 passes through the hole 203 of the holding portion 183 and the hole 173 of the feeding cassette 63, and illuminates the outside of the apparatus.

FIG. 4C is a section view of the holder member 65 illustrating the inside thereof. As illustrated in FIGS. 4B and 4C, the light emitting members 191, 192, and 193 are interconnected by an electric signal line 68. The electric signal line 68 and an electric signal line 69 connected to an unillustrated control board of the printer 100 are connected to each other at a line connecting portion 74.

As described above, in the present embodiment, the single holder member 65 holds the light emitting members 191, 192, and 193 respectively corresponding to the feeding cassettes 61, 62, and 63, and the electric signal line 68, and therefore the holder member 65 constitutes an assembly. Therefore, the holder member 65 formed as an assembly in this manner can be easily attached to and detached from the prop 66 of the apparatus body 90, and thus the efficiency of assembly and maintenance can be improved.

In addition, in a state in which the feeding cassettes 61, 62, and 63 are attached to the apparatus body 90, the light emitting members 191, 192, and 193 are disposed in the vicinity of the holes 171, 172, and 173 of the cassette front cover 81, 82, and 83. Therefore, a light guiding member that guides light from a light emitting member to a cassette front cover does not have to be provided, and the number of parts constituting the cassette feeding portion 60 can be reduced. Therefore, the efficiency of assembly and maintenance can be improved.

Second Embodiment

Next, a second embodiment of the present invention will be described. In the second embodiment, only a temperature/humidity sensor 75 is added to the configuration of the first embodiment. Therefore, elements substantially the same as in the first embodiment will be denoted by the same reference signs or illustration thereof will be omitted.

In some cases, control is performed in accordance with the use environment of an image forming apparatus to stabilize the quality of products output by the image forming apparatus. For example, the temperature and humidity of the use environment of the image forming apparatus are measured to control the strength of a dehumidifying function in a sheet conveyance path or control the temperature of a fixing unit of a heat application type. In this case, the use environment cannot be accurately measured if the temperature/humidity sensor is disposed in the vicinity of a heat generating portion or a suction/exhaustion portion of the image forming apparatus. Therefore, the temperature/humidity sensor needs to be disposed at a position that is as far away as possible from the heat generating portion and the suction/exhaustion port.

Therefore, in most image forming apparatuses, a temperature/humidity sensor is disposed in the vicinity of a cassette front cover of a feeding cassette to avoid "a fixing unit and a sheet conveyance path downstream of the fixing unit", "the vicinity of an image forming portion", and "a rear surface of an image forming apparatus in which a suction/exhaustion port is provided" in an optimized layout.

Figure 5C:
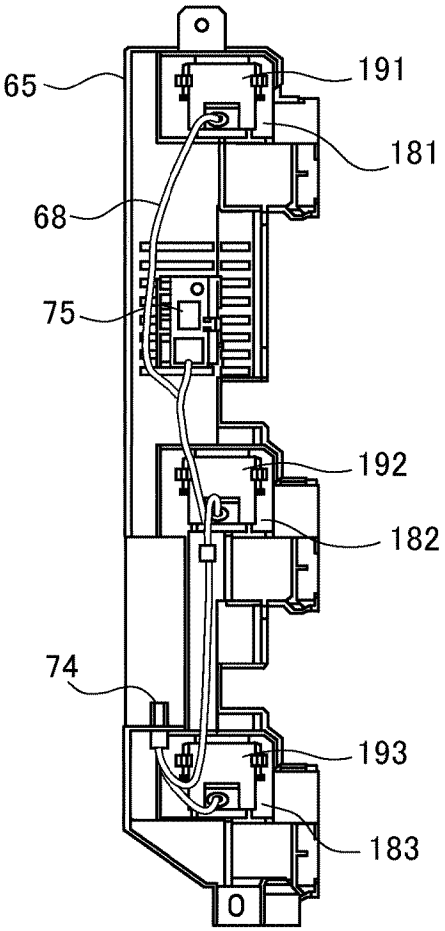
FIG. 5C is a section view of the holder member illustrating an inner configuration thereof.
Figure 5B:
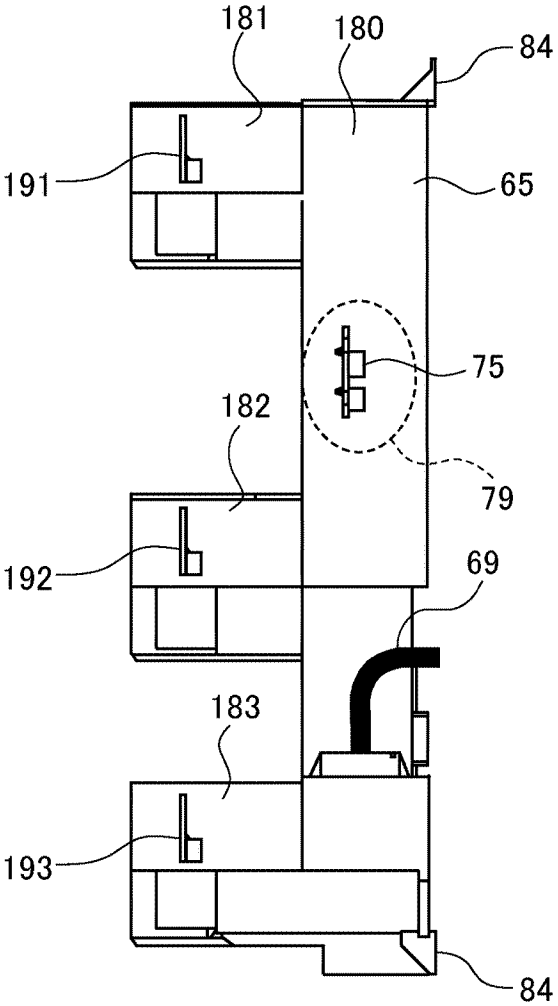
FIG. 5B is a side view of the holder member.
Figure 5A:
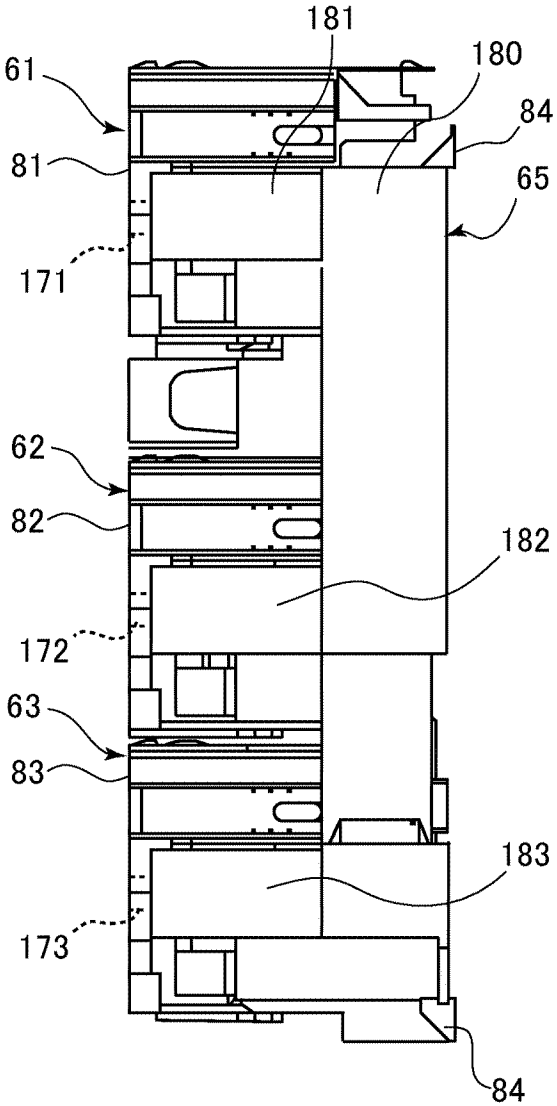
FIG. 5A is a side view of a feeding cassette illustrating a positional relationship between a cassette front cover and a holder member according to a second embodiment.

Therefore, in the present embodiment, as illustrated in FIGS. 5A to 5C, the holder member 65 holds the temperature/humidity sensor 75 serving as a sensor that detects the temperature and humidity. More specifically, the base portion 180 of the holder member 65 includes a sensor holding portion 79 that holds the temperature/humidity sensor 75. Further, a sensor electric signal line 80 connected to the temperature/humidity sensor 75 is provided inside the holder member 65. The electric signal line 68, the sensor electric signal line 80, and the electric signal line 69 connected to the unillustrated control board of the printer 100 are connected to each other in the line connecting portion 74.

The light emitting members 191, 192, and 193 each include an LED, which generates a relatively small amount of heat, and therefore the influence thereof on the temperature/humidity sensor 75 is small. Further, the temperature/humidity sensor 75 is disposed so as to not overlap with the light emitting members 191, 192, and 193 when viewed in the vertical direction, and therefore the heat from the light emitting members 191, 192, and 193 is further less likely to be transmitted to the temperature/humidity sensor 75.

As described above, in the present embodiment, the holder member 65 holds the light emitting members 191, 192, and 193 and the temperature/humidity sensor 75. The holder member 65 formed as an assembly as described above can be easily attached to and detached from the prop 66 of the apparatus body 90, and therefore the efficiency of assembly and maintenance can be improved. In addition, since a member that holds the temperature/humidity sensor 75 does not have to be additionally provided, the cost can be reduced.

Third Embodiment

Next, a third embodiment of the present invention will be described. In the third embodiment, only a display member 87 is added to the configuration of the first embodiment. Therefore, elements substantially the same as in the first embodiment will be denoted by the same reference signs or illustration thereof will be omitted.

Some users desire to know, for each feeding cassette, the brand and size of sheets set therein. Therefore, in the present embodiment, the display member 87 capable of displaying the brand and size of sheets is provided on each feeding cassette. In the description below, the display member 87 provided on the cassette front cover 81 of the feeding cassette 61 will be described, and the same applies to the feeding cassettes 62 and 63.

Figure 6A:
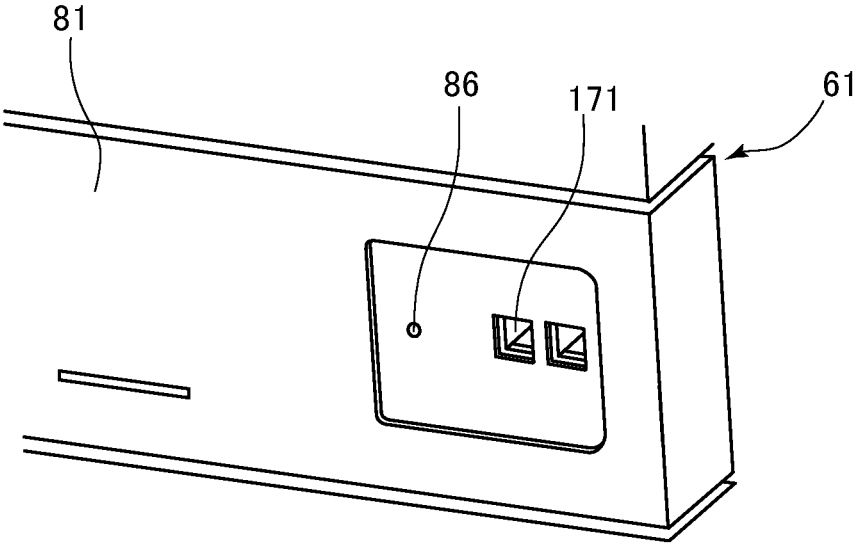
FIG. 6A is a perspective view of a cassette front cover according to a third embodiment from which a display member is detached.
Figure 6B:
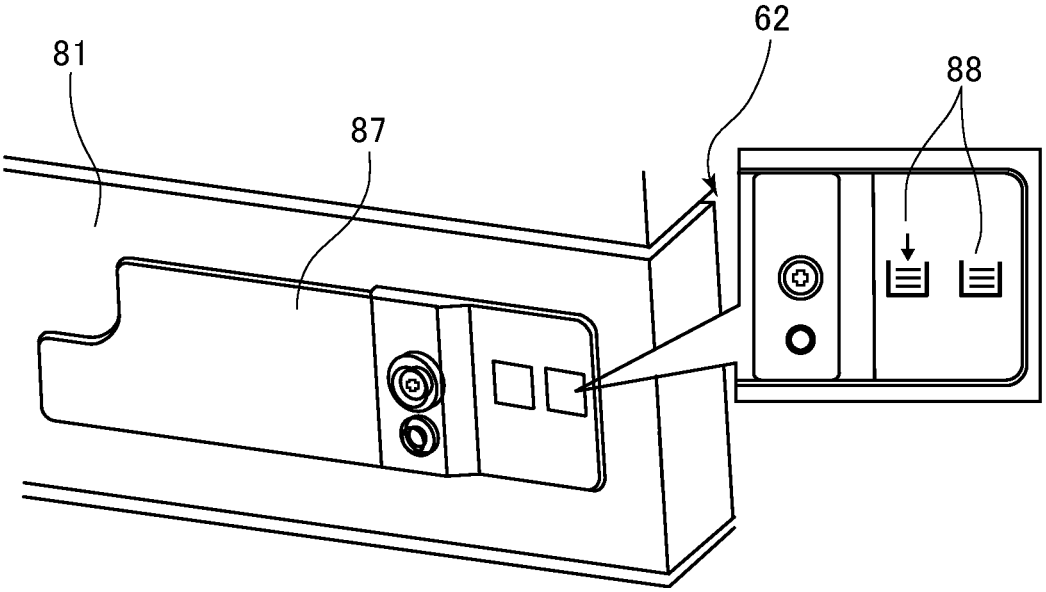
FIG. 6B is a perspective view of the cassette front cover to which the display member is attached.

FIG. 6A is a perspective view of the cassette front cover 81 in a state in which the display member 87 is detached therefrom, and FIG. 6B is a perspective view of the cassette front cover 81 in a state in which the display member 87 is attached thereto. As illustrated in FIGS. 6A and 6B, the hole 171 is defined in the cassette front cover 81 of the feeding cassette 61. In addition, an attachment portion 86 to which the display member 87 can be attached is provided on the cassette front cover 81. The display member 87 serving as a supporting member is screwed to the attachment portion 86.

A diagram or illustration 88 is printed at a position opposing the hole 171 on the display member 87. The diagram 88 illustrated in FIG. 6B is an example of a diagram, and indicates that sheets are accommodated in the feeding cassette 61.

Figure 7A:
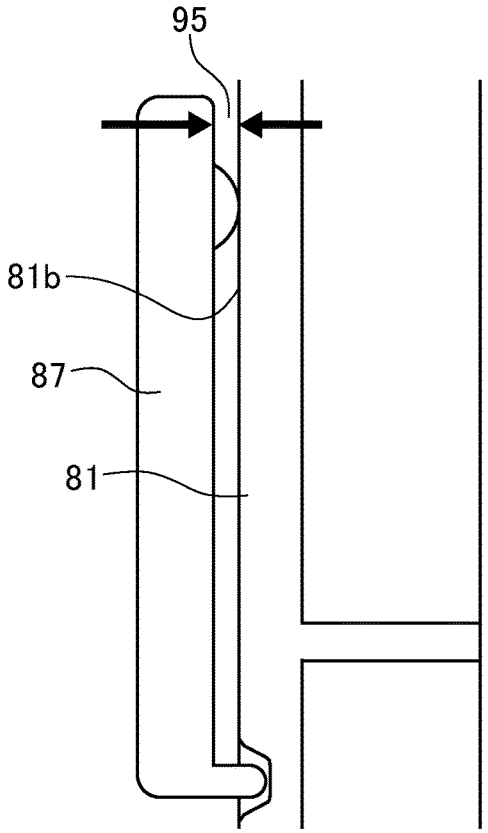
FIG. 7A is a schematic diagram illustrating a gap between a cassette front cover and a display member.
Figure 7B:
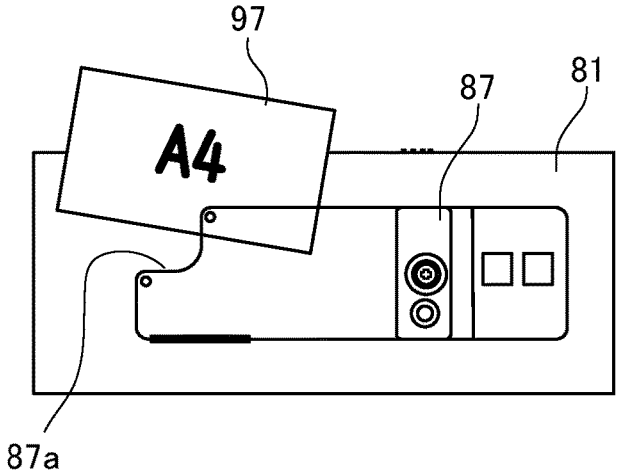
FIG. 7B is a front view of the cassette front cover illustrating how an information member is inserted in the gap.
Figure 7C:
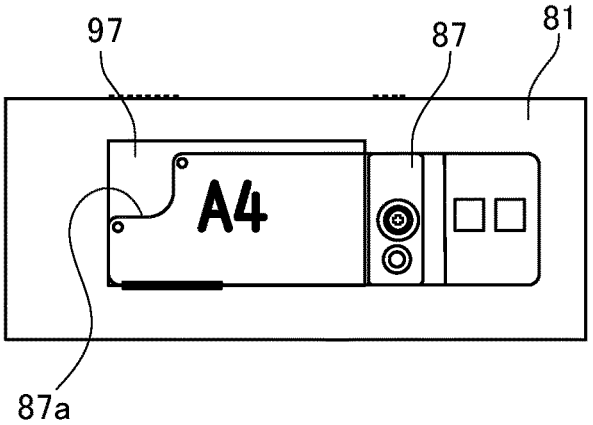
FIG. 7C is a front view of the cassette front cover illustrating the information member held by the display member.

As illustrated in FIG. 7A, the display member 87 is attached to an exterior surface 81*b* of the cassette front cover 81 such that a gap is provided therebetween at least partially. Further, by inserting an information member 97 in a gap 95, the information member 97 is held between the exterior surface 81*b* and the display member 87. The information member 97 carries information of, for example, sheets to be used in the feeding cassette 61 described therein. In FIGS. 7B and 7C, the size of sheets is described in the information member 97.

The display member 87 is a transparent member whose transmittance for visible light is 50% to 100%, and information described in the information member 97 can be visually recognized through the display member 87. In addition, a recess portion 87*a* is preferably provided in the display member 87 such that the information member 97 can be easily removed from the gap 95.

As described above, in the present embodiment, the display member 87 on which the diagram 88 is printed is provided on the cassette front cover 81. Further, the diagram 88 is illuminated by the light emitting member 191, and thus the user can be notified of the state of the cassette feeding portion 60 corresponding to the diagram 88. Examples of the state of the cassette feeding portion 60 include a state in which a sheet accommodated in a feeding cassette is being fed, and a state in which the feeding cassette is short of sheets.

In addition, since the information member 97 in which size information of sheets or the like is described can be held between the display member 87 and the cassette front cover 81, the user can easily recognize information of sheets in the feeding cassette 61,

Other Embodiments

To be noted, although the display member 87 is formed from a transparent member in the third embodiment, the configuration is not limited to this. For example, a cutout or a hole may be provided in the display member 87 such that the user can visually recognize the information member 97 even in the case where the transmittance of the display member 87 is lower than 50%.

In addition, although a diagram is printed on the display member 87 in the third embodiment, the configuration is not limited to this. For example, the display member 87 may be used as a member for holding the information member 97 without printing a diagram thereon.

In addition, although LEDs are used for the light emitting members 191, 192, and 193 in all embodiments described above, the configuration is not limited to this, and other light emitting members such as incandescent lamps and fluorescent lamps may be used.

In addition, although the printer 100 including 3-tier feeding cassettes 61, 62, and 63 has been described as an example in all embodiments described above, the configuration is not limited to this. That is, the number of feeding cassettes is not particularly limited as long as one or more feeding cassettes are provided. In addition, the present invention may be applied to an option feeder connected to the printer 100, a discharge sheet accommodating apparatus that accommodates sheets on which images have been formed, and the like instead of the cassette feeding portion 60 provided in the apparatus body 90.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-097608, filed Jun. 4, 2020, which is hereby incorporated by reference herein in its entirety.

What is claimed is:

1. A sheet accommodating apparatus comprising:

an apparatus body;

a first cassette configured to accommodate a sheet and provided so as to be drawn out in a draw-out direction with respect to the apparatus body;

a second cassette configured to accommodate a sheet and provided so as to be drawn out in the draw-out direction with respect to the apparatus body, the second cassette being disposed adjacent to the first cassette in a vertical direction;

a holder member attached to the apparatus body; and a first light emitting member and a second light emitting member that are supported by the holder member and configured to emit light, wherein the first cassette comprises:

a first accommodating container configured to accommodate a sheet; and a first cover provided downstream of the first accommodating container in the draw-out direction and constituting part of an exterior of the sheet accommodating apparatus, wherein the second cassette comprises:

a second accommodating container configured to accommodate a sheet; and a second cover provided downstream of the second accommodating container in the draw-out direction and constituting part of the exterior of the sheet accommodating apparatus, wherein the first cover has a first hole provided in a position opposing the first light emitting member in the draw-out direction such that the light emitted from the first light emitting member passes therethrough, and wherein the second cover has a second hole provided in a position opposing the second light emitting member in the draw-out direction such that the light emitted from the second light emitting member passes therethrough.

2. The sheet accommodating apparatus according to claim 1, wherein the holder member comprises:

a base portion attached to the apparatus body of the sheet accommodating apparatus;

a first holding portion extending from the base portion in the draw-out direction and configured to hold the first light emitting member; and a second holding portion extending from the base portion in the draw-out direction and configured to hold the second light emitting member, wherein the first holding portion is adjacent to the first hole in a case where the first cassette is attached to the apparatus body of the sheet accommodating apparatus, and wherein the second holding portion is adjacent to the second hole in a case where the second cassette is attached to the apparatus body.

3. The sheet accommodating apparatus according to claim 1, further comprising a sensor supported by the holder member and configured to detect temperature and humidity, wherein the first light emitting member and the second light emitting member each include a light emitting diode.

4. The sheet accommodating apparatus according to claim 3, wherein the sensor is disposed so as not to overlap with the first light emitting member and the second light emitting member when viewed in the vertical direction.

5. The sheet accommodating apparatus according to claim 1, further comprising a supporting member supported with a gap between the supporting member and at least part of an exterior surface of the first cover, wherein the supporting member is configured to oppose the first hole in the draw-out direction.

6. The sheet accommodating apparatus according to claim 5, wherein the supporting member is a transparent member whose transmittance for visible light is 50% to 100%.

7. The sheet accommodating apparatus according to claim 5, wherein a diagram is printed at a position opposing the first hole on the supporting member.

8. An image forming apparatus comprising:

the sheet accommodating apparatus according to claim 1; and an image forming portion configured to form an image on a sheet.

9. The sheet accommodating apparatus according to claim 1, wherein the holder member is configured to be detached from the apparatus body, and the holder member is screwed to the apparatus body.

10. The sheet accommodating apparatus according to claim 1, wherein the apparatus body includes a prop, and the holder member is attached to the prop.

11. The sheet accommodating apparatus according to claim 1, further comprising a signal line connected to the first light emitting member, and the holder member holds the signal line.

* * * * *